US007943020B2

(12) United States Patent
Antozzi et al.

(10) Patent No.: US 7,943,020 B2
(45) Date of Patent: May 17, 2011

(54) CATHODE FOR ELECTROLYTIC PROCESSES

(75) Inventors: Antonio Lorenzo Antozzi, Merate (IT); Claudia Jennifer Bargioni, Milan (IT); Alice Calderara, Milan (IT); Luciano Iacopetti, Milan (IT); Gian Nicola Martelli, Vimodrone (IT); Christian Urgeghe, Redecesio-Segrate (IT)

(73) Assignee: Industries de Nora S.p.A., Milan (IT)

( * ) Notice: Subject to any disclaimer, the term of this patent is extended or adjusted under 35 U.S.C. 154(b) by 0 days.

(21) Appl. No.: 12/422,514

(22) Filed: Apr. 13, 2009

(65) Prior Publication Data

US 2009/0194411 A1 Aug. 6, 2009

Related U.S. Application Data

(63) Continuation of application No. PCT/EP2007/060728, filed on Oct. 9, 2007.

(30) Foreign Application Priority Data

Oct. 11, 2006 (IT) ..... MI2006A1947

(51) Int. Cl.
*C25B 11/08* (2006.01)

(52) U.S. Cl. ..... 204/290.14; 205/149; 205/152; 205/220; 205/224; 205/227; 205/261; 205/264; 205/265; 204/252

(58) Field of Classification Search ..... 204/290.01, 204/290.1, 290.11, 290.12, 290.14, 252; 205/149, 152, 205, 208, 216, 220, 224, 227, 261, 264, 265

See application file for complete search history.

(56) References Cited

U.S. PATENT DOCUMENTS

| | | | | |
|---|---|---|---|---|
| 4,157,943 | A * | 6/1979 | Scarpellino et al. | 205/176 |
| 4,238,311 | A | 12/1980 | Kasuya | |
| 4,465,580 | A | 8/1984 | Kasuya | |
| 5,164,062 | A | 11/1992 | Byrd | |
| 5,855,751 | A | 1/1999 | Rangarajan et al. | |
| 2004/0177556 | A1 * | 9/2004 | Hagemeyer et al. | 48/198.7 |

FOREIGN PATENT DOCUMENTS

| | | | |
|---|---|---|---|
| EP | 298055 | A1 | 1/1989 |
| GB | 1253217 | A | 11/1971 |
| GB | 1511719 | A | 5/1978 |

OTHER PUBLICATIONS

International Search Report for PCT/EP2007/060728 mailed Jul. 18, 2008, p. 1-6.
International Preliminary Report on Patentability for PCT/EP2007/060728 completed Feb. 10, 2009, p. 1-5.
Written Opinion of the International Searching Authority for PCT/EP2007/060728 mailed Jul. 18, 2008, p. 1-2.

* cited by examiner

*Primary Examiner* — Bruce F Bell
(74) *Attorney, Agent, or Firm* — Eschweiler & Associates, LLC

(57) ABSTRACT

The invention relates to a cathode for electrolytic processes, particularly suitable for hydrogen evolution in chlor-alkali electrolysis, consisting of a nickel substrate provided with a coating comprising a protective zone containing palladium and a physically distinct catalytic activation containing platinum or ruthenium optionally mixed with a highly oxidizing metal oxide, preferably chromium or praseodymium oxide.

23 Claims, No Drawings

CATHODE FOR ELECTROLYTIC PROCESSES

CROSS REFERENCE TO RELATED APPLICATION

This application is a continuation of PCT/EP2007/060728 filed Oct. 9, 2007, that claims the benefit of the priority date of Italian Patent Application No. MI2006A001947 filed, Oct. 11, 2006, the contents of which are herein incorporated by reference in their entirety.

BACKGROUND

The invention relates to an electrode for electrolytic processes, in particular to a cathode suitable for hydrogen evolution in an industrial electrolytic process. Reference will be made hereafter to chlor-alkali electrolysis as the typical industrial electrolytic process with hydrogen cathodic evolution, but the invention is not restricted to a specific application. In the electrolytic process industry, competitiveness is associated with different factors, the main of which being energy consumption reduction, directly connected with the process voltage; this justifies the many efforts directed to reduce it in its various components, for instance ohmic drops, which depend on process parameters such as temperature, electrolyte concentration and interelectrodic gap, as well as anodic and cathodic overvoltage. The problem of anodic overvoltage, in principle more critical, was tackled in the past by developing increasingly sophisticated catalytic anodes, based initially on graphite and later on titanium substrates coated with suitable catalysts, which in the case of chlor-alkali electrolysis are specifically directed to decrease chlorine evolution overvoltage. Conversely, cathodic overvoltage naturally obtainable with electrodes made of uncatalysed chemically resistant material (for example carbon steel) were accepted for a long time. The market is nevertheless demanding increasingly high caustic product concentrations, making the use of carbon steel cathodes unviable from a corrosion standpoint; furthermore, the increase in the cost of energy has made the employment of catalysts to be increasingly convenient also to facilitate cathodic hydrogen evolution. The most common solutions known in the art to obviate these needs are represented by the use of nickel substrates, chemically more resistant than carbon steel, and of catalytic materials based on ruthenium oxide or platinum. U.S. Pat. Nos. 4,465,580 and 4,238,311 for instance disclose nickel cathodes provided with a coating of ruthenium oxide mixed with nickel oxide, which for a long time has constituted a more expensive but technically better alternative to the carbon steel cathodes of the previous generation. Such cathodes however were affected by a rather limited lifetime, probably due to the poor adhesion of the coating to the substrate.

A substantial improvement in the adhesion of the catalytic coating on the nickel substrate was introduced by the cathode which comprises a nickel substrate activated with a platinum or other noble metal and a cerium compound, simultaneously or sequentially applied and thermally decomposed in order to obtain a catalytic coating based on platinum or other noble metal either diluted with cerium or, in a preferred embodiment, coated with a porous layer of cerium having a protective function: the role of cerium is in fact to destroy the possible iron-based impurities, which would prove harmful for the noble metal catalyst activity. Albeit an improvement over the prior art, the cathode presented a catalytic activity and a stability in electrolysis conditions not yet sufficient for the needs of present-day industrial processes; in particular, the coating tends to be seriously damaged by the occasional current inversions typically taking place in case of malfunctioning of the industrial plants.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

As provided herein, the invention comprises a new cathode composition for industrial electrolytic processes, in particular for electrolytic processes with cathodic hydrogen evolution. The invention further comprises a cathode composition for industrial electrolytic processes with a higher catalytic activity, a higher duration in the usual process conditions and a higher tolerance to accidental current inversion than the formulations of the prior art.

To the accomplishment of the foregoing and related ends, the following description and drawings set forth certain illustrative aspects and implementations. These are indicative of but a few of the various ways in which one or more aspects may be employed. Other aspects, advantages, and novel features of the disclosure will become apparent from the following detailed description when considered in conjunction with the annexed drawings.

DESCRIPTION

Under a first aspect, the invention comprises a cathode for electrolytic processes, particularly suitable for being employed in the electrolysis of alkali chloride brines (chlor-alkali process) obtained on a nickel substrate and provided with a coating comprising two distinct zones, a first zone comprising palladium and, optionally, silver and having a protective function especially towards current inversion phenomena (protection zone), and a second active zone comprising platinum and/or ruthenium, optionally mixed with a small amount of rhodium, having a catalytic function toward cathodic hydrogen evolution (activation zone). Platinum and ruthenium contained in the activation zone, as well as palladium and silver contained in the protection zone, may be present at least in part in form of oxides. Throughout the description, the presence of a given element is not intended as limited to the metallic form or to the zero oxidation state. In a first embodiment of the invention, palladium is contained in a distinct layer, intermediate between the nickel substrate and the outer activation layer containing the catalyst for hydrogen evolution based on platinum and/or ruthenium. In a second embodiment of the invention, palladium is segregated in islands dispersed within the activation layer containing the platinum and/or ruthenium-based catalyst for hydrogen evolution.

Although palladium to some extent would be suitable per se to catalyse cathodic hydrogen evolution, as known from the scientific literature, in the formulations according to the invention the availability of sensibly more active catalytic sites prevents an appreciable hydrogen evolution to take place on the palladium sites, as will be evident to one skilled in the art. Palladium conversely imparts a surprising effect of lifetime enhancement of the cathodes of the invention, especially in conditions of repeated current inversions due to accidental malfunctioning of the relevant electrolysers. Without wishing to limit the invention to a particular theory, it may be assumed that during the normal electrolysis operation palladium, especially in conjunction with silver, forms hydrides, which are ionised in case of current inversion, thereby preventing the cathode potential to be shifted to values high enough to give rise to significant dissolution phenomena of ruthenium and platinum. Palladium, or even palladium/silver mixtures, would thus behave as a reversible hydrogen sponge capable of releasing hydrogen ionised during the inversion events as soon as normal functioning conditions are restored (self-hydridisation effect). In one embodiment, a 20% Ag molar palladium/silver mixture is advantageously used, but Ag molar concentrations may range from 15 to 25% still showing an optimum self-hydridisation functionality.

In one embodiment, the catalytic component of the cathode of the invention, based on platinum and/or ruthenium, and optionally containing small amounts of rhodium, is stabilised in cathodic discharge conditions upon addition of elements present in form of oxides with high oxidising power. In fact, it was surprisingly observed that the addition of elements like Cr or Pr can preserve the catalyst activity while contributing to the stability thereof. For example, the addition of Pr, in one embodiment in a 1:1 molar ratio (or in one embodiment in a molar ratio of 1:2 to 2:1) with respect to Pt proves particularly effective. Such beneficial effect was also observed with ruthenium oxide-based activations. The fact that praseodymium proved particularly suitable for this function allows to suppose that also the other rare earth group elements capable of forming oxides with high oxidising power are generally suitable for imparting stability to platinum or ruthenium-based catalysts.

In one embodiment of the invention particularly suited to the formulation of cathodes for chlor-alkali processes, a nickel substrate (for instance a mesh or an expanded or punched sheet or an arrangement of parallel slanted strips known in the art as louver) is provided with a dual coating comprised of a catalytic layer containing 0.8 to 5 g/m$^2$ of noble metal (activation zone), and of a protection zone containing 0.5 to 2 g/m$^2$ Pd optionally mixed with Ag, either in form of intermediate layer between the catalytic activation layer and the substrate, or in form of islands dispersed within the catalytic activation layer. By noble metal loading of the catalytic coating according to the invention it is herein intended the content of platinum and/or ruthenium, optionally added with a small amount of rhodium. In particular, the content of rhodium is preferably 10 to 20% by weight of the overall noble metal content in the activation zone.

The preparation of a cathode in accordance with the invention is a particularly delicate operation especially as concerns those embodiments wherein the activation zone is overlaid to a protection zone comprising a palladium-containing intermediate layer. The anchoring of such intermediate layer to a nickel substrate is in fact optimal when it is prepared, as known in the art, starting from palladium precursors, optionally mixed with silver precursors, in acidic solution, for instance by nitric acid. In this way, the nickel of the substrate undergoes some superficial dissolution and the subsequent thermal decomposition gives rise to the formation of a mixed nickel and palladium oxide phase which is particularly compatible in terms of morphological characteristics with the underlying nickel substrate. Hence, the adhesion of the intermediate layer turns out to be optimal. On the other hand, the subsequent deposition of the activation layer proves surprisingly better when alcoholic or more preferably hydroalcoholic solutions are used. In a one embodiment, for the preparation of a cathode on a nickel substrate comprising a protective zone in form of intermediate layer, two distinct solutions are prepared, a first aqueous solution of a Pd precursor, for instance Pd (II) nitrate, for instance acidified with nitric acid and optionally containing an Ag precursor; and a second hydroalcoholic solution, for instance containing Pt (II) diamino dinitrate or Ru (III) nitrosyl nitrate, with the optional addition of a small amount of a rhodium precursor, for instance Rh (III) chloride, and optionally Cr (III) or Pr (III) or other rare earth chloride, for instance in a 2-propanol, eugenol and water mixture. Each of the two solutions, starting from the palladium-containing aqueous solution, is applied in multiple coats, for instance 2 to 4 coats, carrying out a decomposition thermal treatment (typically at temperatures of 400 to 700° C., depending on the chosen precursor) between one coat and the next. After applying the last coat of the second solution, the final thermal treatment provides a high performance-cathode in terms of overvoltage, duration and current inversion tolerance. The indicated precursors are particularly suitable for obtaining a cathode with a final thermal treatment carried out at a limited temperature, characterised by an overall acceptable cost and by optimum performances also in terms of adhesion to the substrate, anyway other precursors may be used without departing from the scope of the invention.

The manufacturing of a cathode according to an embodiment providing a protection zone in form of palladium-rich islands within the activation zone is advantageously carried out by means of the application in multiple coats, for instance 2 to 4, of the same precursors of palladium, ruthenium and/or platinum, and optionally of an additional metal such as chromium, praseodymium or other rare earths, again in a preferably hydroalcoholic solution, even more preferably consisting of a 2-propanol, eugenol and water mixture, with subsequent thermal treatment between 400 and 700° C. after each coat. The method takes advantage of the impossibility to form palladium alloys with platinum and ruthenium in normal conditions due to the difference in the metal lattices of such elements, resulting in physically distinct protection zone and activation zones. A palladium-rich phase (protection zone) tends to segregate in islands within the activation zone, acting as preferential hydrogen absorption sites, particularly useful during the occasional current inversion phenomena.

The invention will be better understood by aid of the following examples, which shall not be intended as a limitation of the scope thereof.

EXAMPLE 1

A 1 mm thick, 30 cm×30 cm nickel net with rhomboidal meshes (4×8 mm diagonals), was subjected to the steps of sand-blasting, degreasing and washing as known in the art, painted with 3 coats of an aqueous solution of Pd (II) nitrate and $AgNO_3$, acidified with nitric acid, with execution of a 15 minute thermal treatment at 450° C. after each coat, until obtaining a deposit of 0.92 g/m$^2$ Pd and 0.23 g/m$^2$ Ag. On the so-obtained palladium-silver layer, 4 coats of Pt (II) diamino dinitrate in a hydroalcoholic solution containing 25% by weight 2-propanol, 30% eugenol and 45% water were applied, with execution of a 15 minute thermal treatment at 475° C. after each coat until obtaining a 2 g/m$^2$ Pt deposit.

The catalytic activity of the cathode thus obtained was determined in a membrane-type sodium chloride brine electrolysis cell producing 32% NaOH at a temperature of 90° C. and at a current density of 6 kA/m$^2$, and compared to a cathode of the prior art consisting of an analogous nickel net activated with the Pt—Ce coating disclosed in Example 1 of EP 298 055, with an equivalent Pt loading of 2 g/m$^2$.

In the course of 8 hours of testing, the voltage of the cell, equipped in both cases with an equivalent titanium anode coated with titanium and ruthenium oxides, remained stable around a value of 3.10 V for the cathode of the invention and 3.15 V for the cathode of EP 298 055.

The tolerance to inversions for the two cathodes was compared by the standard cyclic voltammetry test which provides, at the specified process conditions, alternating the polarisation from −1.05 V/NHE to +0.5 V/NHE and back, at a scan rate of 10 mV/s, until deactivation is observed (loss of catalytic activity with cathodic potential exceeding the value of −1.02 V/NHE at 3 kA/$m^2$).

Following this test, the cathode of the invention showed a tolerance to 25 inversions at the specified experimental conditions versus 4 inversions of the cathode of the prior art. The test demonstrated the higher tolerance to inversions of the cathode of the invention over the one of the prior art, with an at least comparable catalytic activity. It is also known to those skilled in the art that a higher tolerance to inversions is also a reliable indication of a higher overall duration at the usual operating conditions.

EXAMPLE 2

A 1 mm thick, 30 cm×30 cm nickel net with rhomboidal meshes (4×8 mm diagonals), subjected to the steps of sandblasting, degreasing and washing as known in the art, was painted with 3 coats of an aqueous solution of Pd (II) nitrate, acidified with nitric acid, with execution of a 15 minute thermal treatment at 450° C. after each coat until obtaining a deposit of 1 g/$m^2$ Pd. On the so-obtained palladium layer, 4 coats of a hydroalcoholic solution consisting of 25% by weight 2-propanol, 30% eugenol and 45% water, containing Pt (II) diamino dinitrate and Pr (III) nitrate in a 1:1 molar ratio were applied, with execution of a 15 minute thermal treatment at 475° C. after each coat until obtaining a deposit of 2.6 g/$m^2$ Pt and 1.88 g/$m^2$ Pr.

The catalytic activity of the so-obtained cathode was determined by the same test of example 1 and compared to a cathode of the prior art consisting of an analogous nickel net activated with the Pt—Ce coating disclosed in Example 1 of EP 298 055, with an equivalent Pt loading of 2.6 g/$m^2$.

In the course of 8 hours of testing, the cell voltage remained stable around a value of 3.05 V for the cathode of the invention and 3.12 V for the cathode of EP 298 055. The tolerance to inversions for the two cathodes was compared by the standard cyclic voltammetry test of example 1.

Following this test, the cathode of the invention showed a tolerance to 29 inversions at the specified experimental conditions versus 3 inversions of the cathode of the prior art.

EXAMPLE 3

A 1 mm thick, 30 cm×30 cm nickel net with rhomboidal meshes (4×8 mm diagonals), subjected to the steps of sandblasting, degreasing and washing as known in the art, was painted with 5 coats of a hydroalcoholic solution consisting of 25% by weight 2-propanol, 30% eugenol and 45% water, containing Pd (II) nitrate, Pt (II) diamino dinitrate and Cr (III) nitrate, with execution of a 15 minute thermal treatment at 475° C. after each coat until obtaining a deposit of 2.6 g/$m^2$ Pt, 1 g/m Pd and 1.18 g/$m^2$ Cr.

The catalytic activity of the so-obtained cathode was determined by means of the same test of the preceding examples and compared to a cathode of the prior art consisting of an analogous nickel net activated with the Pt—Ce coating disclosed in Example 1 of EP 298 055, with an equivalent Pt loading of 3.6 g/$m^2$.

In the course of 8 hours of testing, the cell voltage remained stable around a value of 3.05 V for the cathode of the invention and 3.09 V for the cathode of EP 298 055. The tolerance to inversions for the two cathodes was compared by the standard cyclic voltammetry test of the previous examples.

Following this test, the cathode of the invention showed a tolerance to 20 inversions at the specified experimental conditions versus 4 inversions of the cathode of the prior art.

EXAMPLE 4

A 1 mm thick, 30 cm×30 cm nickel net with rhomboidal meshes (4×8 mm diagonals), subjected to the steps of sandblasting, degreasing and washing as known in the art, was painted with 5 coats of an aqueous solution acidified with nitric acid, containing Pd (II) nitrate, Pt (II) diamino dinitrate, Rh (III) chloride and Pr (III) nitrate, with execution of a 12 minute thermal treatment at 500° C. after each coat until obtaining a deposit of 1.5 g/$m^2$ Pt, 0.3 g/$m^2$ Rh, 1 g/m Pd and 2.8 g/$m^2$ Pr.

The catalytic activity of the so-obtained cathode was determined by means of the same test of the preceding examples and compared to a cathode of the prior art consisting of an analogous nickel net activated with the Pt—Ce coating disclosed in Example 1 of EP 298 055, with a Pt loading of 3 g/$m^2$.

In the course of 8 hours of testing, the cell voltage remained stable around a value of 3.02 V for the cathode of the invention and 3.08 V for the cathode of EP 298 055. The tolerance to inversions for the two cathodes was compared by the standard cyclic voltammetry test of the previous examples.

Following this test, the cathode of the invention showed a tolerance to 25 inversions at the specified experimental conditions versus 4 inversions of the cathode of the prior art.

Although the disclosure has been shown and described with respect to one or more embodiments and/or implementations, equivalent alterations and/or modifications will occur to others skilled in the art based upon a reading and understanding of this specification. The disclosure is intended to include all such modifications and alterations and is limited only by the scope of the following claims. In addition, while a particular feature may have been disclosed with respect to only one of several embodiments and/or implementations, such feature may be combined with one or more other features of the other embodiments and/or implementations as may be desired and/or advantageous for any given or particular application. Furthermore, to the extent that the terms "includes", "having", "has", "with", or variants thereof are used in either the detailed description or the claims, such terms are intended to be inclusive in a manner similar to the term "comprising."

The invention claimed is:

1. Cathode for electrolytic processes comprised of a nickel substrate provided with a coating, the coating comprising two physically distinct zones consisting of a protection zone and a catalytic activation zone, wherein said protection zone contains palladium and said activation zone contains a platinum and/or ruthenium catalyst for hydrogen evolution.

2. The cathode according to claim 1, the palladium in said protection zone is mixed with silver in a 15 to 25% molar ratio.

3. The cathode according to claim 1, said protection zone comprises an intermediate layer in contact with the nickel substrate and said activation zone comprises an outer catalytic layer.

4. The cathode according to claim 1, said catalyst for hydrogen evolution further comprises at least one oxide of an additional element comprising one or more of chromium and rare earths.

5. The cathode according to claim 4, said additional element comprises praseodymium and the Pt:Pr molar ratio is 1:2 to 2:1.

6. Method for the preparation of a cathode according to claim 4, comprising:

preparing an aqueous solution containing at least one thermally decomposable Pd compound;

preparing a hydroalcoholic solution containing at least one thermally decomposable compound of Pt and/or Ru and at least one compound of an element comprising one or more of chromium and rare earths, said compounds being thermally decomposable;

applying said aqueous solution to a nickel substrate in multiple cycles, with execution of a decomposition thermal treatment after each cycle, until obtaining a palladium-containing deposit; and applying said hydroalcoholic solution to said palladium-containing deposit in multiple cycles, with execution of a decomposition thermal treatment after each cycle, until obtaining a deposit containing Pt and/or Ru mixed with at least one oxide of an element comprising one or more of chromium and rare earths.

7. The method according to claim 6, said aqueous solution contains Pd (II) nitrate.

8. The method according to claim 6, said hydroalcoholic solution contains at least one compound of Pt (II) and/or Ru (III), and at least one compound of an element comprising one or more of chromium and rare earths, in a mixture of 2-propanol, eugenol and water.

9. The method according to claim 8, said at least one compound of Pt (II) and/or Ru (III) is Pt (II) diamino dinitrate or Ru (III) nitrosyl nitrate, and said at least one compound of an element comprising one or more of chromium and rare earths is Pr (III) nitrate or Cr (III) nitrate.

10. The cathode according to claim 1, said protection zone comprising palladium consists of islands dispersed within said activation zone.

11. The cathode according to claim 10, said catalyst for hydrogen evolution further comprises at least one oxide of an additional element comprising one or more of chromium and rare earths.

12. Method for the preparation of a cathode according to claim 10, comprising:

preparing a hydroalcoholic solution containing at least one thermally decomposable compound of Pd and at least one compound of Pt and/or Ru, said compounds being thermally decomposable; and applying of said solution to a nickel substrate in multiple cycles, with execution of a decomposition thermal treatment after each cycle, until obtaining a Pt and/or Ru-containing deposit and segregated palladium-containing islands.

13. The method according to claim 12, said solution further contains at least one compound of an element comprising one or more of chromium and rare earths.

14. The method according to claim 13, said at least one compound comprising one or more of chromium and rare earths comprises Pr (III) nitrate or Cr (III) nitrate.

15. The method according to claim 12, said solution also contains at least one compound of Ag and said segregated islands contain Ag.

16. The method according to claim 12, said at least one compound of Pd comprises Pd(II) nitrate and said Pt and/or Ru compound comprises Pt (II) diamino dinitrate or Ru (III) nitrosyl nitrate.

17. The cathode according to claim 1, the specific loading of Pd expressed as element is 0.5 to 2 $g/m^2$ and the overall specific loading of Pt and Ru expressed as elements is 0.8 to 5 $g/m^2$.

18. The cathode according to claim 1, said activation zone contains rhodium at a specific loading of 10 to 20% the overall noble metal loading in said activation zone.

19. Method for the preparation of a cathode according to claim 1, comprising:

preparing of an aqueous solution containing at least one thermally decomposable Pd compound;

preparing a hydroalcoholic solution containing at least one thermally decomposable compound of Pt and/or Ru;

applying said aqueous solution to a nickel substrate in multiple cycles, with execution of a decomposition thermal treatment after each cycle, until obtaining a palladium-containing deposit; and applying said hydroalcoholic solution to said palladium-containing deposit in multiple cycles, with execution of a decomposition thermal treatment after each cycle, until obtaining a Pt and/or Ru-containing deposit.

20. The method according to claim 19, said aqueous solution containing Pd (II) nitrate.

21. The method according to claim 19, said hydroalcoholic solution contains at least one compound of Pt (II) and/or Ru (III) in a mixture of 2-propanol, eugenol and water.

22. The method according to claim 21, said compound of Pt (II) comprises Pt (II) diamino dinitrate and said compound of Ru (III) comprises Ru (III) nitrosyl nitrate.

23. Cell for the electrolysis of an alkali chloride brine including at least one cathode of claim 1.

* * * * *